United States Patent [19]

Grunert et al.

[11] 4,206,436

[45] Jun. 3, 1980

[54] ELECTRICAL APPARATUS ENCAPSULATED WITH RESIN COATED FILLER

[75] Inventors: Kurt A. Grunert, Beaver; John J. Henwood, Brighton Township, Beaver County, both of Pa.

[73] Assignee: Westinghouse Electric Corp., Pittsburgh, Pa.

[21] Appl. No.: 717,968

[22] Filed: Aug. 26, 1976

[51] Int. Cl.[2] ..... H01F 27/02

[52] U.S. Cl. ..... 336/96; 174/DIG. 1; 174/52 PE

[58] Field of Search ..... 336/96, 205; 174/DIG. 1, 52 PE

[56] References Cited

U.S. PATENT DOCUMENTS

| | | | |
|---|---|---|---|
| 3,161,843 | 12/1964 | Hodges et al. | 336/96 |
| 3,434,087 | 3/1969 | Hofmann | 336/96 |
| 3,493,531 | 2/1970 | Hofmann et al. | 336/96 |
| 3,824,328 | 7/1974 | Ting et al. | 174/52 PE |

*Primary Examiner*—Benjamin R. Padgett
*Assistant Examiner*—J. L. Barr
*Attorney, Agent, or Firm*—D. P. Cillo

[57] ABSTRACT

An electrical apparatus, comprising an electrical conductor, is encapsulated with a cured, solid insulation comprising bonded, catalyzed, resin coated filler particles, where the resin constitutes from about 1 weight percent to about 12 weight percent of the resin coated filler particle weight.

8 Claims, 2 Drawing Figures

ELECTRICAL APPARATUS ENCAPSULATED WITH RESIN COATED FILLER

BACKGROUND OF THE INVENTION

The usual method of insulating electrical apparatus, such as transformer coils and magnet actuation coils, is to encapsulate them with a resinous, liquid potting composition. This potting composition is generally an anhydride cured epoxy resin, which may contain up to about 2 parts of a silica filler per 1 part epoxy, as taught by Smith in U.S. Pat. No. 3,784,583. Use of over about 70 weight percent silica in the liquid composition presents problems of pourability, although use of large amounts of silica improves the electrical properties of the encapsulant.

Problems associated with a liquid composition, containing about 30 weight percent liquid resin, are relatively short shelf life and difficulty in bulk handleability. If a solvent is used with such large amounts of resin, then ecological problems may be presented in solvent removal during cure.

Large amounts of silica or sand in combination with a resin and curing agent have been used in various support systems. Fitko et. al., in U.S. Pat. No. 2,706,188, used up to 90 weight percent sand, 8 weight percent amine curing agent and 2 weight percent phenolic resin, to make a free flowing, dry, partially reacted resin coated sand composition, for use in shell molding processes for casting molten metals. Vondracek et. al., in U.S. Pat. No. 3,598,241, used up to 98 weight percent silica or sand and 2 weight percent amine catalyzed phenolic or epoxy resins, or peroxide catalyzed polyester resins, to make a free flowing, dry, resin coated sand composition, for use as a reverse osmosis membrane support tube.

What is needed in the electrical industry, is an easily handleable, pourable, dry potting composition which will have an excellent shelf life, and allow ease of insertion into complex geometries, and cure without major pollution problems.

SUMMARY OF THE INVENTION

The above need is met by encapsulating an electrical apparatus, comprising at least an electrical conductor, and more specifically, an electrical wound coil of copper or aluminum wire or foil, with a coating of bonded resin coated filler particles. The filler particles, preferably sand, have a granular structure and a particle size range of between about 10 microns to about 300 microns. The resin is preferably a catalyzed phenolic resin. The resin constitutes from about 1 weight percent to about 12 weight percent, but preferably from about 3 weight percent to about 10 weight percent of the catalyzed, resin coated filler particle weight.

The encapsulant insulation walls disposed about the electrical apparatus, may optionally be coated with a water resistant sealant, to a depth of between about 0.05 inch to about 0.25 inch, or an adhesive tape, to insure a non-porous insulation surface. This dry, potting composition has been found to be free flowing, allowing ease of pouring into complex geometries. It cures without pollution problems, has a shelf life of at least about 12 months without gellation or bonding, and provides a crack resistant, strong, potting material having excellent insulating properties. This potting composition has been found especially useful to encapsulate transformer coils, magnet actuators, switches, motor controllers with overload relays and various other types of electrical conductors, coils and controls.

BRIEF DESCRIPTION OF THE DRAWINGS

For a better understanding of the invention, reference may be made to the preferred embodiment, exemplary of the invention, shown in the accompanying drawings in which.

DESCRIPTION OF THE PREFERRED EMBODIMENTS

Figure 1:
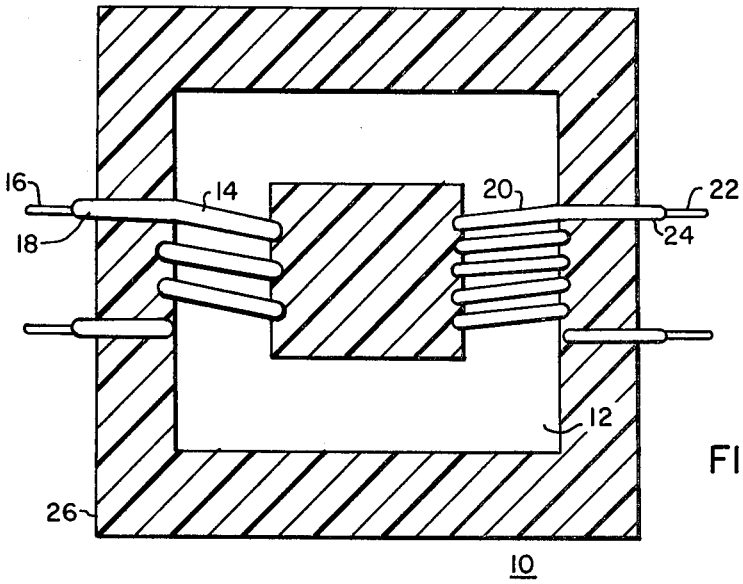
FIG. 1 shows a vertical section through a transformer or magnet actuator.

A resin solution, usually with an added catalyst, is coated onto filler particles in such a way as to leave a thin, dry, unreacted and uncured film on each particle. The resulting particulate composition is free flowing and can be poured around electrical conductors, switches, various types of other electrical control devices, and the core and windings of other electrical apparatus, such as transformer coils and magnet actuator coils. This can provide a thin, crack resistant, inexpensive insulation.

The composition is then heated to cure the resin. A sealant material can optionally be coated, pasted, taped or otherwise applied onto the outside surface of the cured resin coated filler, to provide a consolidated, non-porous, water and vapor resistant insulating composition encapsulating the conductor or electrical apparatus. The curing process transforms the resin coated filler into a strong, rigid, relatively void free insulation. On curing, the thin film of resin bonds each filler particle to the adjacent particles.

The amount of resin used can be adjusted to give a considerable range in strength and porosity of the resultant insulation. Use of between about 1 weight percent to about 12 weight percent resin, preferably between about 3 weight percent to about 10 weight percent resin, based on the total weight of the catalyzed resin coated filler composition, will provide the best compromise of minimum voids, high filler loading and high strength in the cured insulation. Below 1 weight percent resin and the insulation will be too porous for electrical insulating applications and too weak to remain crack free during operation of the encapsulated electrical apparatus.

Phenolic resins, which are preferred because they can be bought cheaply and in readily usable form are well known in the art and are thoroughly discussed in Megson, Phenolic Resin Chemistry, Academic Press, 1958, particularly chapter 3. They are conventionally obtained by reacting a phenolic substance such as phenol itself or substituted phenols such as cresols, xylenols, or butyl phenol with an aldehyde such as formaldehyde, propionaldehyde, acetaldehyde, benzaldehyde or furfural. The characteristics of the materials formed by the reaction of phenols with aldehydes can be varied widely by choice and ratio of reactants and by such reaction conditions as acidity, alkalinity, temperature, time, catalysts or accelerators and presence and nature of solvent or diluent.

One-step phenolic resins (resols) are made with basic catalysts such as inorganic hydroxides, quaternary ammonium hydroxides, or tertiary amines. This type of resin has at least one mol of formaldehyde per mole of phenol. The first part of the reaction is the addition of the formaldehyde to the phenol to form a phenol alcohol or methylol phenol. The second part of the reaction is condensation polymerization wherein the initially water soluble product is transformed into a resin of increasing molecular weight and decreasing water tolerance. Curing of one-step resins occurs by the further condensation of residual methylol groups to yield an insoluble, infusible network structure.

Two-step phenolic resins (novolaks) are obtained with acidic catalysts and less than one mol of formaldehyde per mol of phenol. In the acid catalyzed reaction, although methyols are formed as intermediates, they are immediately, under the influence of the acid, converted to methylene links. These resins are characterized by requiring additional formaldehyde or some cross-linking agent such as hexamethylenetetramine to cure.

Other resins well known in the art which may be used as the coating and bonding agent in this invention include: epoxy resins, i.e. polyglycidyl ethers (see Lee and Neville, Handbook of Epoxy Resins, McGraw Hill, 1966, particularly chapter 2), polyesters (see Bjorksten, Polyesters And Their Applications, Reinhold Publishing Corporation, 1956, pages 1–34), silicones and polystyrenes (see Brydson, Plastic Materials, D. Van Nostrand Company, 1966, chapters 25 and 13), and polyimide and polyamide-imide resins (see Frost and Bower, "Aromatic Polyimides," J. Polymer Science, Part A, Volume 1, 1963 3135–3150, and U.S. Pat. Nos. 3,179,631; 3,179,632; 3,179,633 and 3,179,634 on polyimides and U.S. Pat. No. 3,179,635 on polyamide-imides).

Solvents which have beem found to be suitable for use in this invention comprise, in general, alcohols, such as methanol, ethanol, propanol, isopropanol, and the like; ketones such as acetone, aromatic hydrocarbons such as xylene, toluene, benzene, and the like, and the normally liquid organic solvents of the N,N-dialkylcarboxylamide class such as dimethyl acetamide and the like. It will be understood, of course, that the particular solvent employed must be a solvent for the particular resin used.

The majority of these resins are curable to a solid state by heating them to their curing temperature in the presence of an effective amount of a suitable polymerization catalyst. Usually, between about 0.5 weight percent to 5 weight percent catalyst based on the weight of the total composition will be effective to cause complete cure of the resin. Examples of suitable catalysts would include, for example when the resin is a phenolic resin, hexamethylenetetramine, formaldehyde, paraformaldehyde, furfuraldehyde, acetaldehyde, polymethylolphenols, alkali metal and alkaline earth metal salts of the polymethylolphenols. When the resin is an epoxy resin, suitable catalysts would include dicyandiamide, triethanolamine borate, metaphenylenediamine, diphenylamine, melamine, quinolene, hexamethylenetetramine, urea, and substituted ureas such as alkyl ureas an example being tetraethyl urea, and guanidines. When the resin is a polyester resin, examples of suitable catalysts would include, benzoyl peroxide, laurol peroxide, methyl ethyl ketone peroxide, t-butyl hydroperoxide, ascaridole, tert-butyl-perbenzoate, di-t-butyl diperphthalate, ozonides and the like. When the resin is a silicone, examples of suitable catalysts would include, dicumyl peroxide, benzoyl peroxide, laurol peroxide, methyl ethyl ketone peroxide, t-butyl hydroperoxide, di-t-butyl diperphthalate, ozonides, and the like. When the resin is a polystyrene resin examples of suitable catalysts would include benzoyl peroxide, laurol peroxide, tertiary-butyl hydroperoxide, di-tertiary-butyl peroxide and tert-butyl-perbenzoate.

The finely divided inorganic filler particles used in accordance with this invention may be spherical, oval, cubical, or of other irregular configuration. Some examples of suitable filler particles include silica (sand), quartz, beryllium aluminum silicate, and mixtures thereof. The preferred average particle size range is between about 50 microns and about 150 microns although the outer limits are between about 10 microns and about 300 microns. Below about 10 microns average particle size and it is difficult to effectively coat the filler particles and maintain good flow characteristics. Over about 300 microns average particle size and too many voids will be produced after cure for electrical insulating applications.

Electrical apparatus including electrical conductors, transformer coils, magnet actuators, rectifiers, and electronic components such as electrical switches, motor controller assemblies or other types of electrical apparatus where electrical conductors must be isolated, can be potted or cast within the completely reactive, catalyzed resin compositions of this invention. Referring to FIG. 1 of the drawings, there is illustrated a potted transformer or magnet actuator 10 which comprises a magnetic core 12 provided with one winding 14 which comprises an electrical conductor 16 which is insulated with insulation 18 and another winding 20 which comprises a conductor 22 also insulated with insulation 24. The magnetic core 12 with its associated windings 14 and 20 disposed about the core are completely potted in the cured resin coated filler compostion 26 of this invention.

When the transformer is put into operation, its insulation and component parts are subject to dynamic stresses when surges and short circuits pass through the windings. The sudden increase in current flow during surges and short circuits on the windings creates shock forces that severely stress the insulation and component parts. It is necessary that the insulation applied to encapsulate the transformer be able to withstand such stresses. This is true to a lesser extent in a magnet actuator.

Figure 2:
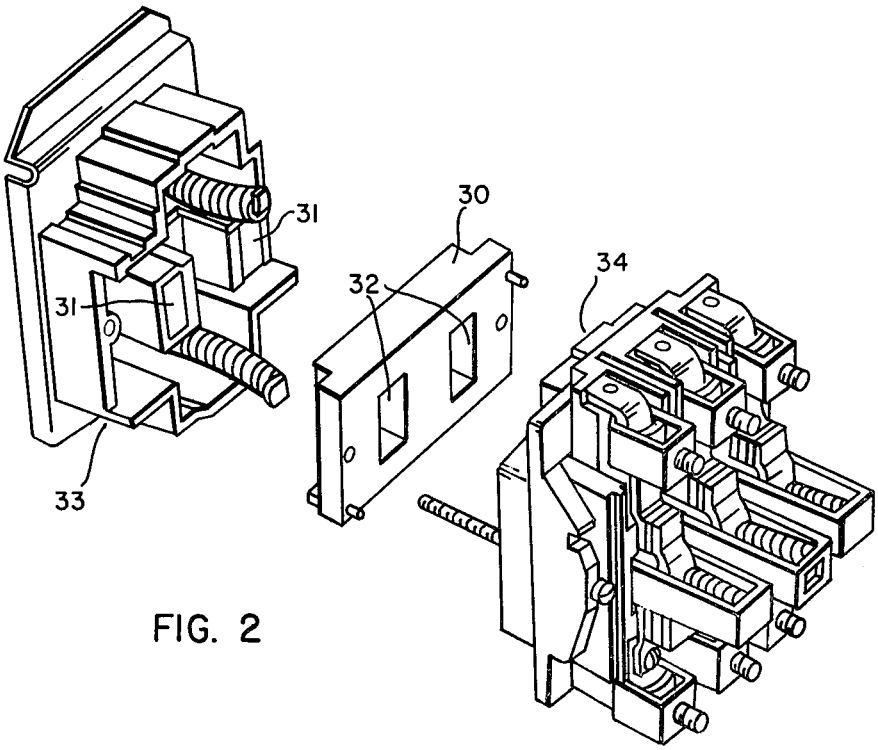
FIG. 2 shows an exploded perspective view of a horizontal reversing motor controller with a block type overload relay and an encapsulated magnet actuator coil.

When an electrical switch is encapsulated, the insulation must be able to maintain its shape in spite of impacts due to operation of magnetic contactors and solenoids in the switch. FIG. 2 shows a horizontal reversing motor controller, 3 pole, with a block type overload relay in an exploded view. The magnet actuator coil 30 can be encapsulated with the composition of this invention as a thin insulating coating. The magnet 31 fits within the coil openings 32. The back support assembly 33 can be cast about the coil and magnet eliminating use of the combination metal and plastic assembly shown. Also visible are the stationary carriers, moving carriers, overtravel springs, crossbars and other components associated with this type of electrical apparatus, shown in front assembly 34.

The outside surface of the insulating encapsulant is preferably protective covered coated with an adhesive tape or an amount of sealant composition to effect a penetration of between about 0.05 inch to about 0.25 inch deep into the insulating wall. This insures a void free, nonporous wall surface. Useful sealant compositions include, for example any water resistant plastic or rubber material such as oil base paints, varnishes and acrylic lacquers. These sealants can be brushed or sprayed onto the wall surface, or the encapsulated electronic device can be dipped into a bath of the sealant. Epoxy silicone or other type water resistant adhesive tapes can also be applied to provide a water resistant sealing barrier.

EXAMPLE 1

To 1,000 grams of washed dry sand having an average particle size of about 60 microns (230 mesh-U.S. Screen No.) was added about 18 grams of hexamethylenetetramine catalyst. This was mixed for about 1 minute in a muller. Then, about 56 grams of the reaction product of a phenol and an aldehyde, in solution, having a viscosity at 25° C. of about 4,200 cps. and a solids content of about 67 percent (sold commercially by Hooker Corporation under the trade name Durez Phenolic Resin), was added and the combination mixed in a muller for about 10 minutes until it was dry and free flowing.

The composition had an excellent shelf life, and was stored for 16 months, in a relatively high humidity atmosphere, without major increase in resin viscosity, gellation, sticking and any harmful effects to its bonding, strength or curing properties. The composition contained about 3.5 weight percent phenolic resin, i.e. (56)(0.67 solids)/[(56)(0.67)+1000+18], and about 1.7 weight percent catalyst, the rest, about 94.8 weight percent was sand filler. No heat was used in the resin coating process to react or fuse the resin, as the sand particles were adequately coated by the thorough mixing alone.

This phenolic coated sand potting composition was then poured into an enclosure surrounding a 2 inch diameter magnet actuator core with associated copper windings, and a 3 inch diameter core with associated copper windings for a 50 VA transformer. The potting composition flowed easily and was disposed about each core and complex configuration of coil and windings. The enclosures containing the magnet actuator and transformer and potting composition were then placed in a forced air oven and heated at about 160° C. to 170° C. for ¾ hour. This bonded the resin coated sand particles together and cured the phenolic resin.

The assemblies were then removed from the oven and allowed to cool in air to 25° C., after which the enclosures were removed. The coated filler particles provided a solid, consolidated insulation, about 0.25 inch thick, encapsulating the transformer and magnet actuator.

As an optional step, the walls of the insulation were then brushed with an acrylic lacquer as a plastic sealant, at atmospheric pressure, to seal the walls and provide a void free, non-porous, water resistant and vapor resistant insulation wall surface. Penetration of the sealant was about 0.18 inches into the wall surface of both the encapsulated transformer and magnetic actuator.

The transformer and magnetic actuator were then refrigerated to −40° C. Then, 120 volts potential was applied to both apparatus, to internally heat the coils and core, causing an 85° C. temperature rise. The power was shut off and each apparatus was recooled to −40° C. Each apparatus was then heated in an oven to 175° C. with no effect on the integrity of the insulation.

Each apparatus was then subjected to 2,400 volts between one winding and the outside insulation surface for one minute. Again, there was no deterioration of the encapsulating insulation for the transformer or the magnet actuator indicating good dielectric constant properties. These tests showed that the cured, resin coated filler was an excellent insulator for electrical apparatus and electrical conductors.

In a similar fashion, electrical switches containing electrical contacts, conductor termination points, magnetic contactors and solenoids were encapsulated with the above described catalyzed phenolic coated sand composition. Acrylic lacquer was then sprayed on the wall surface effecting penetration of about 0.10 inch. These switches were used for over 11 million operations during which the insulation did not crack and maintained its shape during impacts of the magnetic contacts and solenoids.

Use of the other resins and fillers described above would provide equally suitable results, as would use of other plastic or rubber water resistant compositions or various types of adhesive tapes to seal the encapsulant walls.

We claim:

1. An encapsulated electrical apparatus comprising an electrical conductor coated with a cured solid insulation, the solid insulation coating consisting essentially of bonded, catalyzed, phenolic resin coated filler particles having a granular structure, wherein the phenolic resin constitutes from about 1 to about 12 weight percent of the catalyzed, resin coated filler particle weight, the filler particles are selected from the group consisting of silica, sand, quartz, beryllium aluminum silicate and mixtures thereof, and have an average particle size of between 50 microns to 150 microns, and the outside of the cured solid insulation is treated with a water resistant sealant in a manner effective to provide a nonporous surface.

2. The electrical apparatus of claim 1, wherein the outside of the cured solid insulation is coated with a water resistant sealant effective to penetrate the insulation to a depth of between about 0.05 to about 0.25 inch and provide a non-porous insulation surface.

3. The electrical apparatus of claim 1, wherein the outside of the cured solid insulation is covered with a water resistant adhesive tape.

4. The electrical apparatus of claim 1, wherein the resin is phenolic novolac resin catalyzed with hexamethylene tetramine, and constitutes from about 3 to about 10 weight percent of the catalyzed, resin coated filler particle weight.

5. The electrical apparatus of claim 1 wherein the apparatus is an electrical coil containing wound conductors selected from the group consisting of copper and aluminum.

6. The electrical apparatus of claim 1 wherein the apparatus is a magnet actuator coil.

7. The electrical apparatus of claim 1 wherein the apparatus is a transformer coil.

8. The electrical apparatus of claim 1 wherein the apparatus is an electrical switch.

* * * * *